United States Patent [19]

Evenson

[11] 4,180,997

[45] Jan. 1, 1980

[54] SINGLE PIECE SELF-SUPPORTING SHOE FOR USE IN A CONDUIT BENDER

[75] Inventor: Raymond M. Evenson, New Berlin, Wis.

[73] Assignee: Applied Power Inc., Milwaukee, Wis.

[21] Appl. No.: 896,758

[22] Filed: Apr. 17, 1978

[51] Int. Cl.[2] ..... B21D 7/024

[52] U.S. Cl. ..... 72/217

[58] Field of Search ..... 72/154, 157, 219, 217, 72/149, 218, 212, 383, 388, 389, 396, 400, 457, 459

[56] References Cited

U.S. PATENT DOCUMENTS

| | | | |
|---|---|---|---|
| 2,232,819 | 2/1941 | Abramson et al. | 72/217 |
| 2,375,310 | 5/1945 | Mandl | 72/154 |
| 3,555,868 | 1/1971 | Hagemeyer | 72/219 |
| 3,914,972 | 10/1975 | Gillette et al. | 72/212 |
| 3,987,656 | 10/1976 | Evenson | 72/217 X |

*Primary Examiner*—Milton S. Mehr

*Attorney, Agent, or Firm*—Andrus, Sceales, Starke & Sawall

[57] ABSTRACT

A single piece self-supporting shoe of generally oblong shape for use in a conduit bender. The shoe has oppositely disposed arcuately shaped outwardly facing grooves on opposite side portions and is capable of bending either thin or thick wall conduit of varying sizes, all with the same shoe by employing different radii in the opposed grooves of the shoe.

4 Claims, 10 Drawing Figures

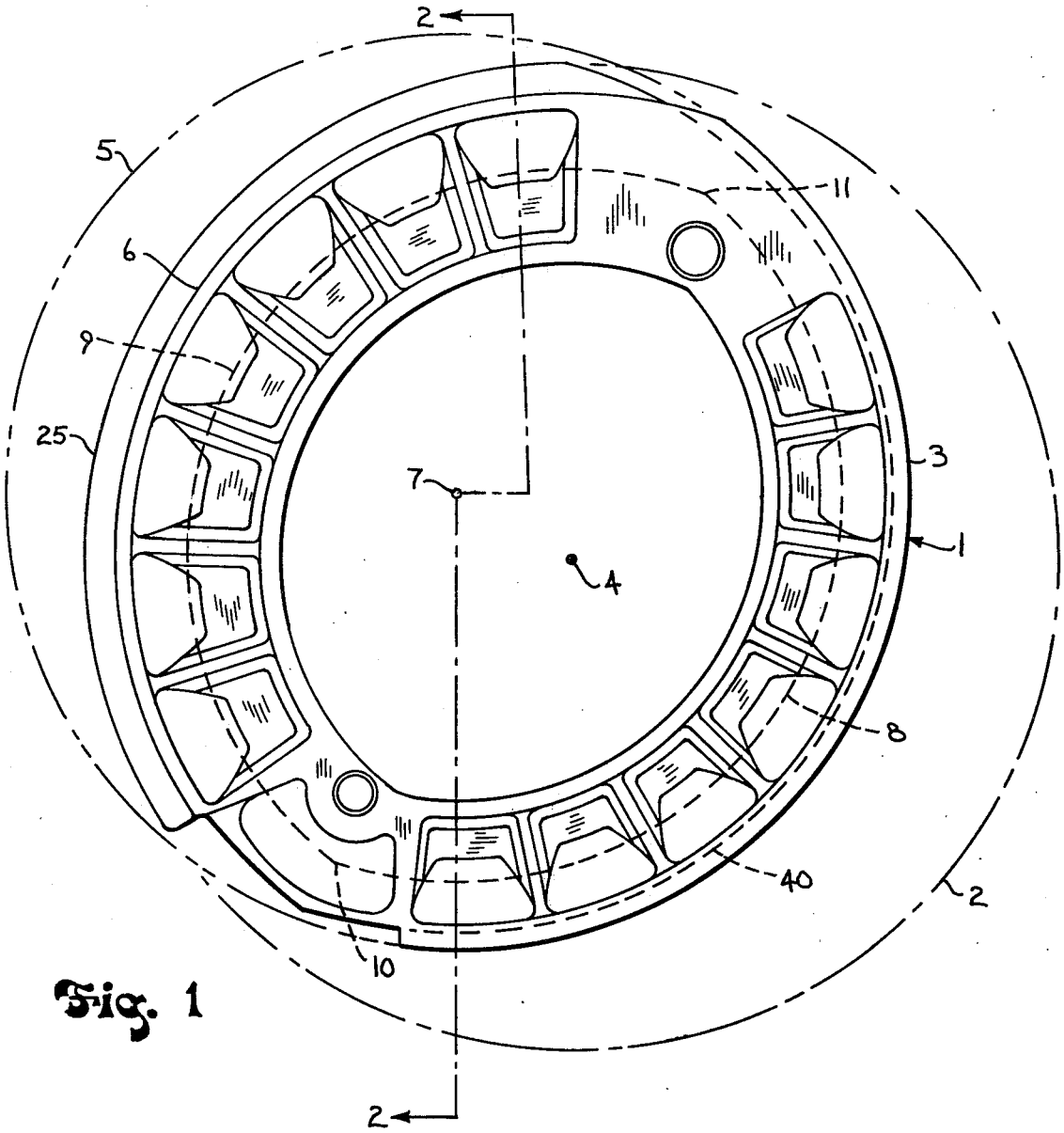
Fig. 1
Fig. 3
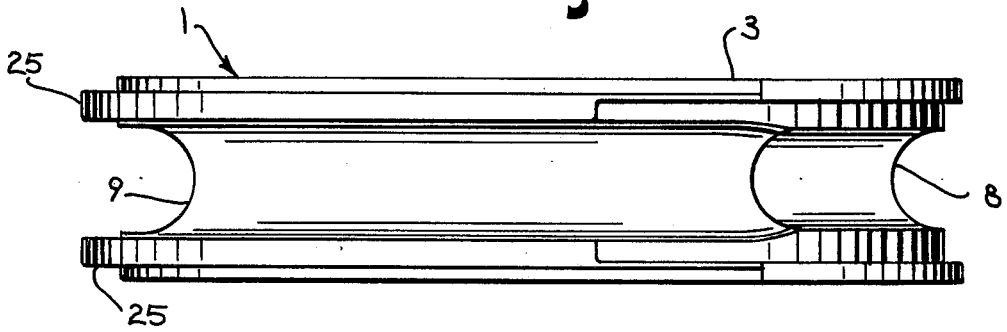

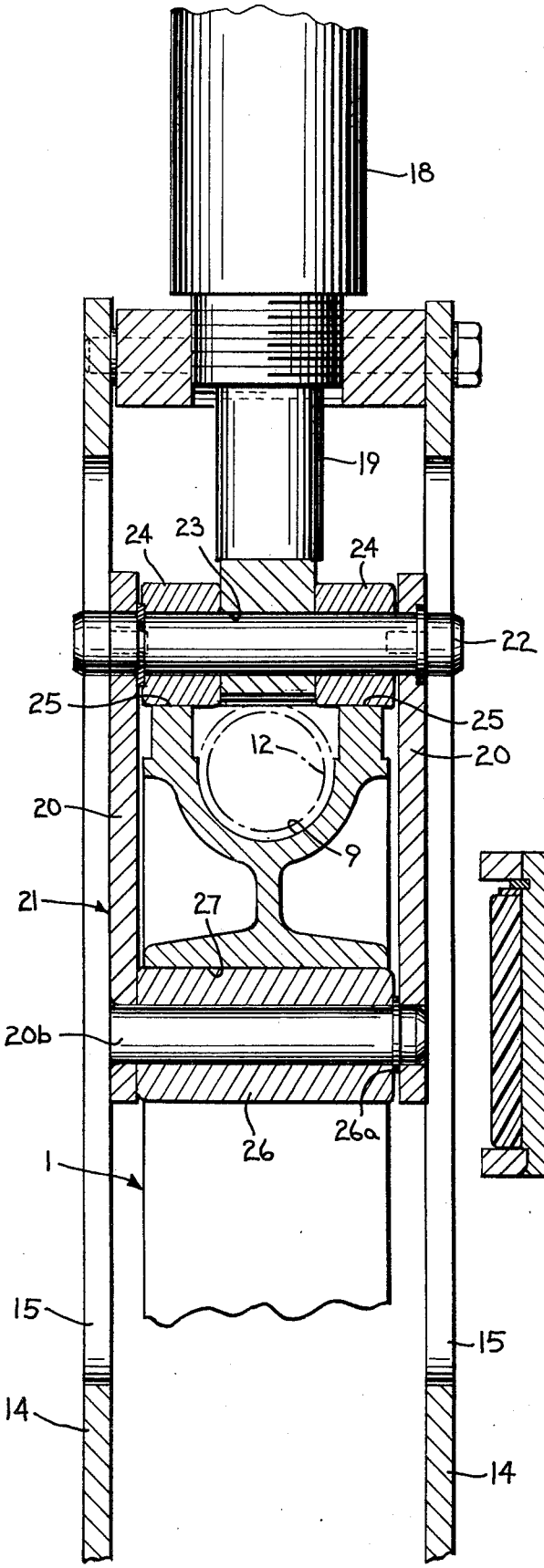
Fig. 7
Fig. 8
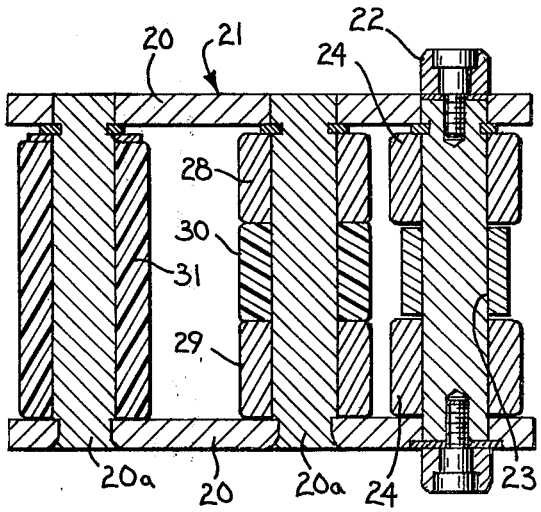

SINGLE PIECE SELF-SUPPORTING SHOE FOR USE IN A CONDUIT BENDER

BACKGROUND OF THE INVENTION

Previously shoes for conduit benders for bending thin wall tubing or conduit and intermediate and rigid conduit depended for their operation upon either an internal pivot point support or upon internal access permitting the application of a sizable force therein such as is often produced by a hydraulic ram to drive the shoe. These internal structures of such shoes were integral with their function and tended to limit their design. The present invention provides a single piece self-supporting shoe for multiple uses, thereby achieving the multiple benefits of (1) fewer parts, (2) lighter combined weight, (3) smaller combined bulk, (4) reduced costs, and (5) enhanced user convenience.

SUMMARY OF THE INVENTION

The invention in general is directed to a bending shoe which is of a single piece self-supporting construction and has no internal supports because one side of the shoe of the bender supports the opposite side of the shoe of the bender.

The layout of the bending shoe on opposite sides is initially developed in the arc of a circle so that one side of the shoe has a center of radius which is offset from the center of the radius of the other side of the shoe and the centers are independent of each other. In the construction of the bending shoe, the arc of the circles which would be formed have been compressed so that the bending shoe normally takes an oblong shape. This decreases the size of the shoe and makes it of lighter weight.

Outwardly facing arcuately shaped grooves extend on opposite sides of the bending shoe and have radii of different length so that on one side of the shoe thin wall electrical metallic tubing can be bent and on the other side of the shoe intermediate and rigid wall conduit can be bent. Because the bending shoe has been compressed from a circular member to an oblong shape there is no interference with either type of conduit at the end of the bending operation by the bent conduit being placed in engagement with the groove on the opposite side of the shoe at the junction of the grooves.

BRIEF DESCRIPTION OF THE DRAWINGS

FIG. 1 is a plan view of the bending shoe of the invention with phantom lines indicating the areas of the bending shoes if carried into a full circle;

FIG. 3 is a top plan view of the bending shoe illustrated in FIG. 1 showing the respective grooves in opposite sides of the shoe;

FIG. 7 is a cross-sectional view taken on line 7—7 of FIG. 4;

FIG. 8 is a cross-sectional view taken on line 8—8 of FIG. 4;

DESCRIPTION OF THE PREFERRED EMBODIMENT

Figure 2:
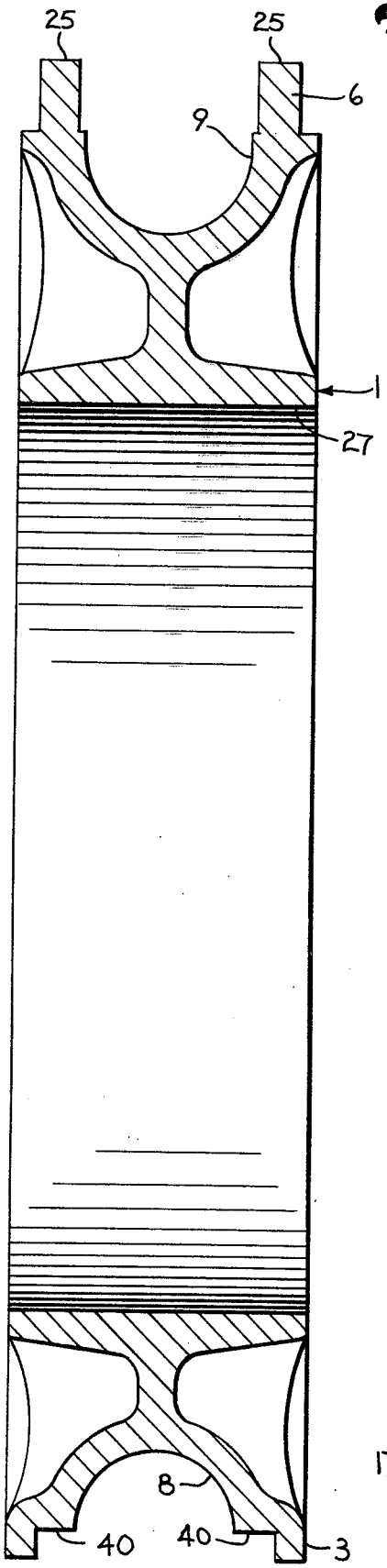
FIG. 2 is a cross-section of the bending shoe taken on line 2—2 of FIG. 1.

Referring to the drawings, there is shown in FIG. 1 of the drawings the conduit bending shoe 1 of the invention which is illustrated as of generally oblong shape. Shoe 1 is of single piece self-supporting construction of continous extent with each respective side of the shoe supporting the opposite side of the shoe when the latter side is in bending service. This eliminates the need for any internal braces.

In FIG. 1 the phantom lines 2 illustrate the right-hand portion 3 of shoe 1 if it were carried into the arc of a circle were shoe 1 to be constructed in that manner and the center 4 of such circle is shown as located inside of shoe 1. The phantom lines 5 illustrate the left-hand portion 6 of shoe 1 if it were carried into the arc of a circle were the shoe to be constructed in that manner and the center 7 of such circle is shown as located inside of shoe 1 and is independent of and offset from center 4 of the circle which has been phantomized with respect to the right-hand portion 3 of shoe 1. By compressing shoe 1 into an oblong shape from a circular shape the shoe can be made smaller and of lighter weight.

Figure 4:
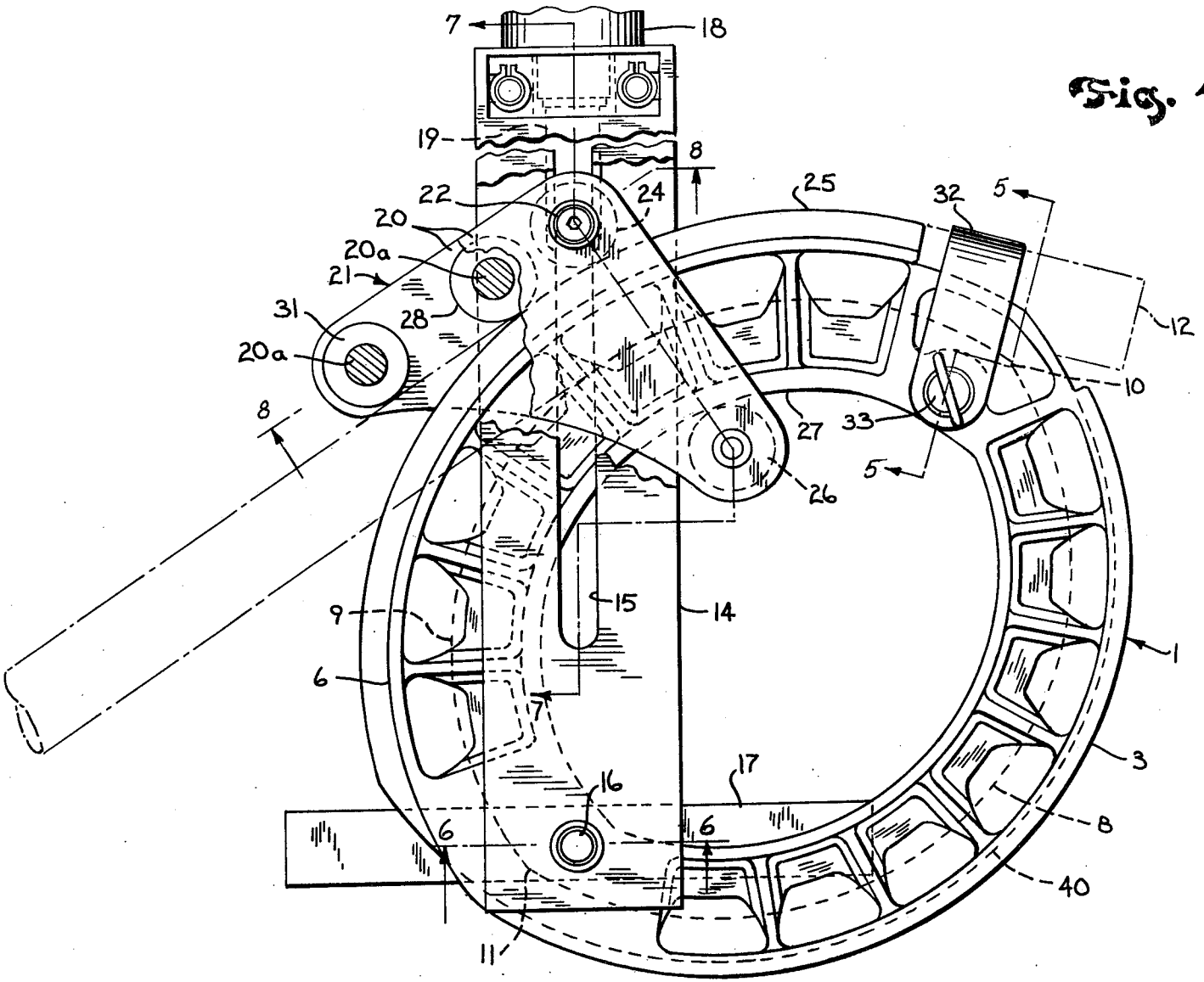
FIG. 4 is a plan view of the conduit bender with the bending shoe in an intermediate position and being operated on an intermediate conduit without the use of a follow bar.

Referring to FIGS. 3 and 2 there is shown the continuous arcuate groove 8 on the right-hand portion of shoe 1 which has a radius of lesser length than the radius of the continuous arcuate groove 9 in the left-hand portion 6 of shoe 1. The respective grooves 8 and 9 terminate at junctures 10 and 11 at the lower and upper part of shoe 1, as shown in FIG. 4, and because of the oblong shape of shoe 1 the intermediate or rigid one and one-half inch conduit 12 being bent in shoe 1 as shown in FIG. 4 for purposes of illustration does not merge into the opposite groove at junctures 10 and 11 of grooves 8 and 9. A minimum 90° bend is obtainable on the size and wall thickness of conduit which shoe 1 of the invention is capable of handling.

Both of grooves 8 and 9 are illustrated to bend conduit 12 having a nominal inner diameter of one and one-half inches. Although the inner diameter of conduit 12 may be essentially the same with respect to a thinner wall conduit, because of the differences in the thickness of the wall of both conduits the outer diameter of the thicker wall conduit will be greater. By providing the arcuate grooves 8 and 9 in shoe 1 of different radii, this makes shoe 1 capable of bending both the thin and rigid or thicker wall conduit.

The radius of groove 8 in shoe 1 is of lesser length than the radius of groove 9 and is employed to bend electrical thin wall metallic tubing or conduit. Groove 9 is used to bend intermediate metal conduit and rigid aluminum and rigid steel conduit which has a thicker wall than the thin wall tubing or conduit 34 illustrated in FIG. 9. Shoe 1 has found its greatest use in bending the described thin and thick wall conduit in nominal sizes such as 1", 1¼", 1½", and 2".

Figure 9:
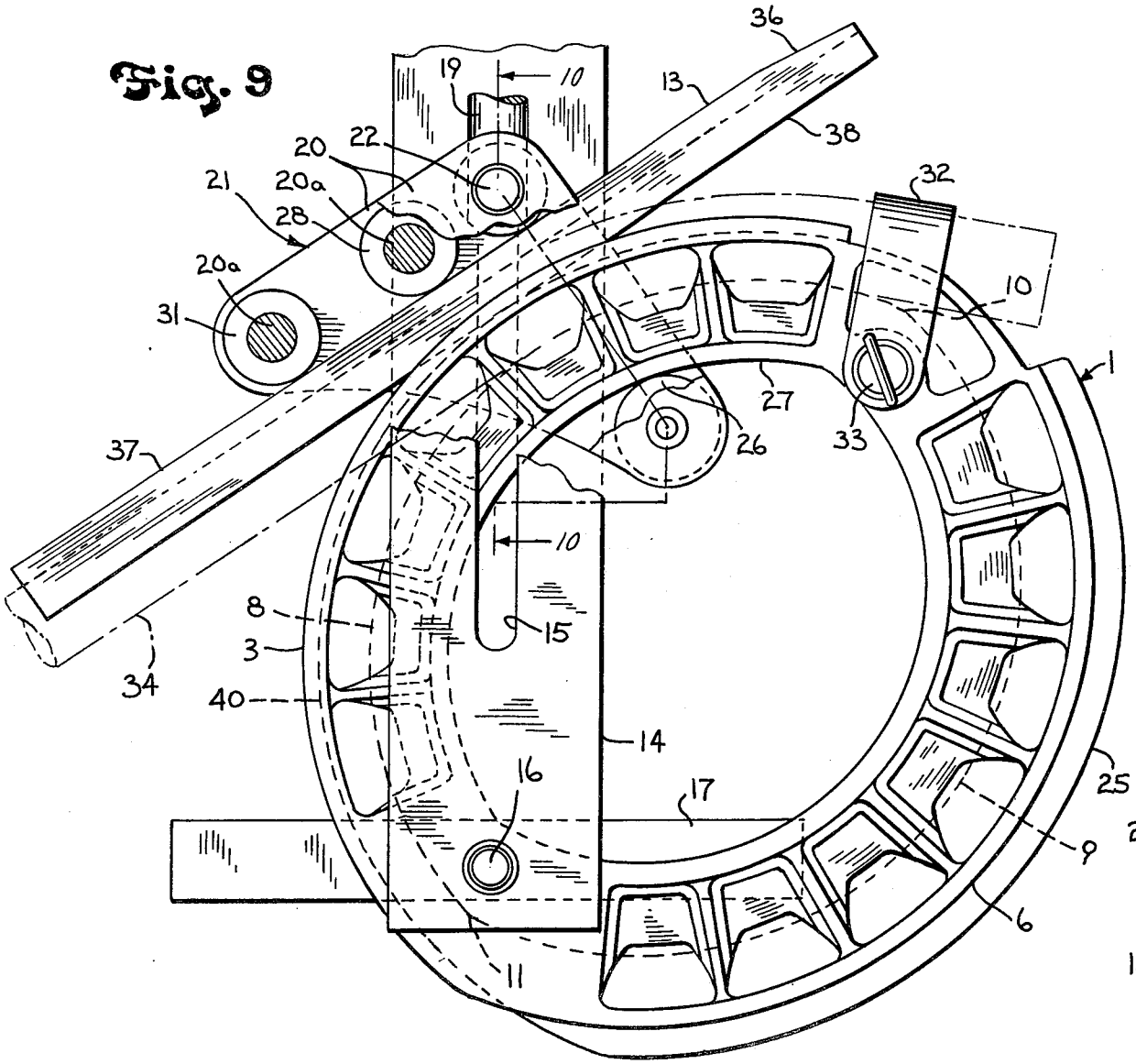
FIG. 9 is a view similar to FIG. 4 with the bending shoe in an intermediate position but illustrating the use of a follow bar.

In bending conduit a follow bar 13 as illustrated in FIG. 9 is required for the thin wall conduit there shown and for 2" intermediate and rigid metal conduit. However, no follow bar 13 is required for bending intermediate and rigid metal conduit under 2", or thin wall conduit under 1¼".

The construction of the conduit bender apparatus other than shoe 1 is similar to that described in U.S. Pat. No. 3,987,656 which is assigned to the same assignee as the present invention and reference to that patent may be made for a more detailed description of the conduit bender.

Figure 5:
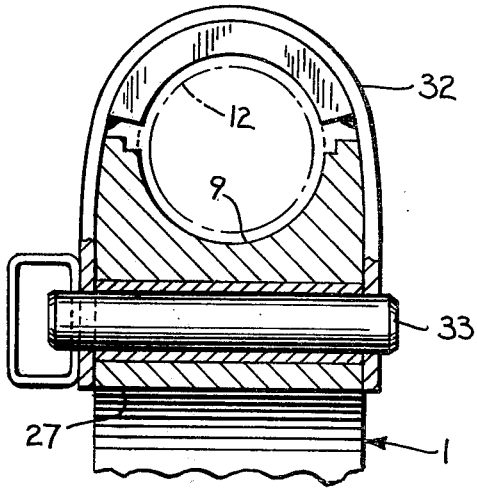
FIG. 5 is a cross-sectional view taken on line 5—5 of FIG. 4 illustrating the saddle used to hold the conduit.
Figure 6:
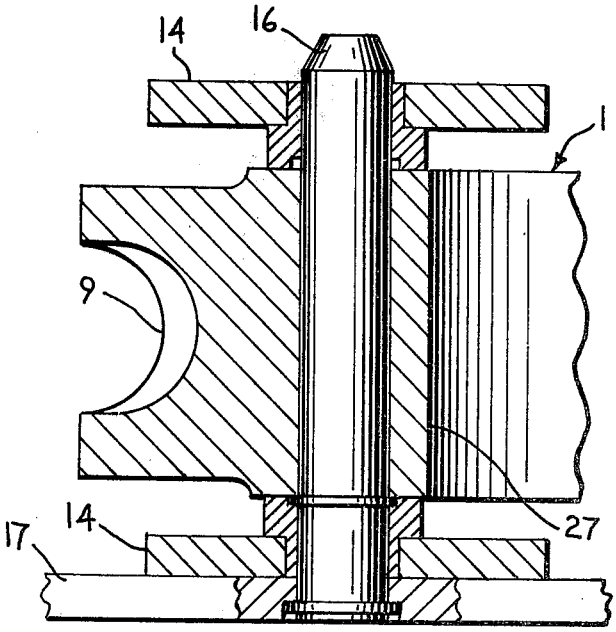
FIG. 6 is a cross-sectional view taken on line 6—6 of FIG. 4.

Referring to FIGS. 4, 5 and 6, shoe 1 is shown as assembled within the conduit bender and actuated to bend conduit 12. No follow bar 13 is used to bend conduit 12 because conduit 12 is illustrated as intermediate metal conduit with a nominal 1½" inner diameter. Conduit 12 is lodged in groove 9 at the left side 6 of shoe 1.

In general the conduit bender has an elongated frame 14 which has a central slot 15. The pivot pin 16 extends through one end of frame 14 and through a stabilizer 17 and shoe 1 to secure shoe 1 to frame 14 and stabilizer 17 and facilitates free pivotal movement of shoe 1 in a horizontal plane with respect to frame 14. Top frame member 14 can readily be removed.

The conduit bender is actuated by a hydraulic motor 18 which is secured to frame 14 at the end opposite the location of pin 16. The piston rod 19 of motor 18 extends between the upper and lower members of frame 14 and is pivoted to the upper and lower plates 20 of the roller clamping assembly 21 by the captive pin 22 which rides within slot 15 and extends through the eye 23 provided at the lower end of piston rod 19. The metal rollers 24 are provided on opposite sides of the eye 23 of piston rod 19. The rollers 24 engage the respective rims 25 bordering the mouth of the groove 9.

The plates 20 of roller assembly 21 have an inner large metal roller 26 which is clamped against the inside surface 27 of shoe 1, as can be seen in FIG. 7, and is located parallel with pin 22. In addition, as illustrated in FIG. 8, on the outside of shoe 1 additional rollers are provided between upper and lower plates 20, rollingly engaged on axles 20*a*.

These rollers consist of short rollers 28 and 29 of metal between which is located roller 30 of an elastomer material softer than metal such as urethane, for example. An additional large roller 31 of soft material such as urethane, is secured to plates 20 outwardly of rollers 28, 29 and 30.

As previously noted, FIG. 7 illustrates the inner roller 26 clamped in engagement with the inside surface 27 of shoe 1 and the metal rollers 24 in engagement with the respective rims 25 at the mouth of groove 9 of shoe 1 to securely enclose conduit 12 within groove 9 of shoe 1. The soft rollers 30 and the central portion of roller 31 ride in clamping engagement directly with conduit 12 when the roller assembly 21 is rotated to bend conduit 12. In turn the metal rollers 28 and 29 as with metal rollers 24, ride on the respective rims 25 of shoe 1 as the roller assembly 21 is rotated.

The rotation of roller assembly 21 is accomplished by operation of the hydraulic motor 18 which actuates piston rod 19 connected to the roller clamping assembly 21 by the captive pin 22.

When the conduit 12 is initially loaded into the bender it is necessary that the inner end portion be clamped to shoe 1. This is accomplished by a U-shaped saddle 32 which extends over conduit 12 and is secured to shoe 1 by the readily removable pin 33 which extends through the legs of saddle 32 and through shoe 1.

Figure 10:
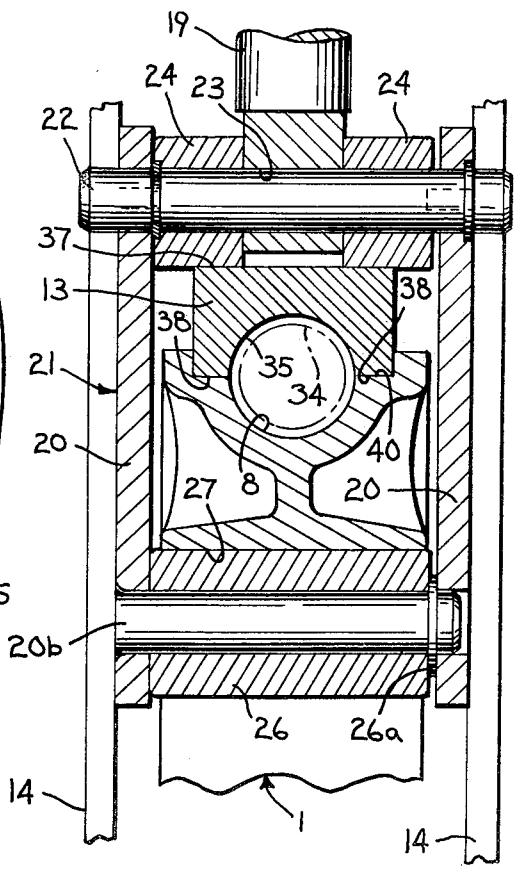
FIG. 10 is a cross-sectional view taken on line 10—10 of FIG. 9.

Turning now to FIGS. 9 and 10, for purposes of illustration, there is shown the bending of thin wall electrical tubing or conduit 34 having a nominal diameter of one and one-half inches. In order to accomplish the bending of conduit 34, it is necessary to disassemble the conduit bending apparatus in a similar manner as described in detail in U.S. Pat. No. 3,987,656. In general this involves lifting off top frame member 14 and the top plate sub-assembly of roller assembly 21, which sub-assembly consists of top plate 20, affixed axle pin 20*b*, and large metal roller 26 rollingly attached to its axle, such as by a snap ring 26*a*. Saddle 32 has been already removed when the bending of conduit 12 has been completed.

Shoe 1 is then lifted off from captive pivot pin 16 and turned over and the bender apparatus reassembled to expose the annular groove 8 initially on the right-hand portion 3 to the left-hand side of shoe 1 for reception of conduit 34 to be bent to the desired angle.

Because of the thin wall of conduit 34, it is necessary that the follow bar 13 be used to prevent conduit 34 from collapsing during bending. Follow bar 13 is of elongated construction and has a groove 35 therein which conforms to the outer circumferential surface of conduit 34, as illustrated in FIG. 10. The forward end 36 of follow bar 13 is slightly inclined for ready insertion into the bending apparatus. Before the start of the bending operation the follow bar 13 is inserted between conduit 34 and the roller assembly 21 so that the rollers located on the outer side of the roller assembly 21 ride on the flat back surface 37 of follow bar 13.

The respective rims 38 of the follow bar seat upon the ledges 40 which are provided adjacent to groove 8 of shoe 1 at the mouth of groove 8 and securely hold conduit 34 within groove 8.

After the follow bar 13 is inserted and the hydraulic motor 18 is actuated, piston rod 19 is gradually extended within frame 14 and follow bar 13 then moves forwardly together with conduit 34 as the bar and conduit pass through the roller assembly 21 until the desired angle of bend of conduit 34 is achieved.

To remove conduit 34 after it is bent, the piston rod 19 is retracted by actuation of motor 18 in the opposite direction and conduit 34 and follow bar 13 are then removable.

The intermediate conduit 12 and thin wall conduit 34 of a nominal inner diameter of one and one-half inches have been described for purposes of describing the invention and, of course, different nominal diameters of conduit may be bent by using the appropriate size shoe of the invention.

In the operation of the bending apparatus which is only necessary to describe with respect to FIG. 4 because the operation is the same with respect to FIG. 9 except for follow bar 13, conduit 12 is inserted into shoe 1 and the hydraulic motor 18 is actuated. Piston rod 19 which is in retracted position is thereby caused to extend. This creates a torque on bending shoe 1 by the roller assembly 21 which is connected to the eye 23 of piston rod 19. This actuates the bending shoe 1 around pivot pin 16. The rollers of roller assembly 21 are forced against conduit 12 to place a compressive force on conduit 12. Conduit 12 in turn exerts a force on the arcuate surface of groove 9 of shoe 1 in a direction generally normal to groove 9 thereby creating a torque on bending shoe 1 about the pin 16 which results in rotation of bending shoe 1 around pin 16. When the bending operation is complete piston rod 19 is retracted which causes the bent conduit 12 to be delivered out of the machine.

The invention provides a versatile bending shoe which is of a single piece self-supporting construction with continuous grooves having arcuate surfaces of different radii on opposite sides of the shoe so that electrical thin wall metallic conduit and intermediate and rigid metal conduit of different outside diameters can be bent in the same shoe. This minimizes the number of loose bending shoes lying around on a job and provides a complete set of shoes which are fewer in number and of less weight.

Because one side of the shoe supports the other, to make the shoe self-supporting it is not necessary to have any reinforcement within the shoe. The oblong shape of the shoe provides a smaller shoe and of lighter weight with the center of each side of the shoe being offset and independent of each other. In addition the oblong shape eliminates the problem of the advancing end of a conduit being bent running into the arcuate groove of a different radius at the juncture of the grooves.

Various modes of carrying out the invention are contemplated as being within the scope of the following claims, particularly pointing out and distinctly claiming the subject matter which is regarded as the invention.

I claim:

1. A single piece continuously extending self-supporting multiple bending shoe for use in conduit bending apparatus, said shoe having an outwardly facing arcuately shaped groove extending on opposite sides of the shoe with the radius of each respective groove being of different length so that thin wall conduit and intermediate and rigid wall conduit of different outside diameters can be received in the respective grooves on opposite side portions of the shoe and bent in the shoe to the angular configuration desired, and the bending shoe on opposite sides being developed in the arc of a circle so that one side of the shoe has a center of radius which is offset from the center of the radius of the other side of the shoe with said centers being independent of each other.

2. The single piece continuously extending self-supporting bending shoe of claim 1 wherein the shoe has a generally oblong shape preventing engagement of the advancing end of the conduit being bent in one arcuate groove of a defined radius by running into the opposite arcuate groove of a different radius.

3. The single piece continuously extending self-supporting bending shoe of claim 2 and the groove on one side of the shoe having a radius of a length to receive and hold the intermediate and rigid metallic conduit without the use of a follow bar and the groove on the opposite side of the shoe having a radius of a length to hold the thin wall metallic conduit, and a ledge at the mouth of the latter groove to support a follow bar in engagement with the conduit to be bent.

4. In a conduit bender having a single piece continuously extending self-supporting multiple bending shoe for use in bending conduit, said shoe having a generally oblong shape with independent and offset centers for each side of the shoe, and arcuately shaped outwardly facing groove extending on both sides of the shoe defined by a pair of spaced rims with the radius of each respective groove being of different length so that predetermined thin wall conduit and thicker wall conduit in a wide range of diameters can be received in the respective grooves and bent in the shoe to the angular configuration desired, a frame for the bender, removable means pivoting the shoe to the frame, a roller assembly having on one side of the shoe inner means engaging the inside surface of the shoe and outer roller means disposed on the outside of the shoe comprising hard roller means engaging the rims of the grooves of the shoe and soft roller means engaging the conduit and riding directly with the conduit during bending, and co-operating with the inner roller to clamp the thicker wall conduit into the groove, and outwardly facing ledges defining the mouth of the groove on the opposite side of the shoe with said groove having radii of lesser length than the first named groove to bend thin wall conduit, a follow bar disposed on said ledges between the conduit and roller assembly when the shoe is turned over and reassembled with the roller assembly to bend predetermined thin wall conduit and co-operating with the roller assembly to clamp the last named conduit into said last named groove for bending, a hydraulic motor, and means pivoting the hydraulic motor to the frame and roller assembly to thereby actuate the roller assembly to rotate the same and the respective conduits to bend the latter to a predetermined angle.

* * * * *